US009121261B2

(12) United States Patent
McColpin et al.

(10) Patent No.: US 9,121,261 B2
(45) Date of Patent: Sep. 1, 2015

(54) COILED TUBING SYSTEM WITH MULTIPLE INTEGRAL PRESSURE SENSORS AND DTS

(71) Applicant: Halliburton Energy Services, Inc., Houston, TX (US)

(72) Inventors: Glenn Robert McColpin, Katy, TX (US); Brian Park, Austin, TX (US); Kenneth Glenn Dixson, Houston, TX (US); Mikko Jaaskelainen, Katy, TX (US); Maximo Gustavo Michaelis, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 325 days.

(21) Appl. No.: 13/771,287

(22) Filed: Feb. 20, 2013

(65) Prior Publication Data

US 2014/0231066 A1 Aug. 21, 2014

(51) Int. Cl.

| | |
|---|---|
| ***E21B 47/06*** | (2012.01) |
| ***E21B 47/01*** | (2012.01) |
| ***E21B 17/20*** | (2006.01) |

(52) U.S. Cl.

CPC ..... *E21B 47/06* (2013.01); *E21B 17/206* (2013.01); *E21B 47/01* (2013.01)

(58) Field of Classification Search

CPC ..... E02B 47/06; E02B 17/026

See application file for complete search history.

(56) References Cited

U.S. PATENT DOCUMENTS

| | | | | |
|---|---|---|---|---|
| 5,973,270 | A * | 10/1999 | Keller | 174/136 |
| 6,116,085 | A | 9/2000 | Moffatt et al. | |
| 6,523,609 | B1 * | 2/2003 | Miszewski | 166/66 |
| 2004/0168794 | A1 * | 9/2004 | Vold | 166/65.1 |
| 2005/0006102 | A1 * | 1/2005 | Cho | 166/376 |
| 2006/0219401 | A1 * | 10/2006 | Longfield et al. | 166/250.1 |
| 2011/0073210 | A1 | 3/2011 | Stretch et al. | |
| 2012/0024052 | A1 * | 2/2012 | Eriksen | 73/152.51 |
| 2012/0152518 | A1 * | 6/2012 | Johanning et al. | 166/65.1 |
| 2014/0230232 | A1 * | 8/2014 | Jaaskelainen et al. | 29/592.1 |

FOREIGN PATENT DOCUMENTS

| | | | | |
|---|---|---|---|---|
| GB | 2377717 A * | 1/2003 | | E21B 17/10 |
| WO | WO 02081862 A1 * | 10/2002 | | E21B 17/02 |

* cited by examiner

*Primary Examiner* — Frederick L Lagman

(74) *Attorney, Agent, or Firm* — Michael A. Ervin; Krueger Iselin LLP

(57) ABSTRACT

A multiple integral pressure transducer system for installation in oil field downhole coiled tubing systems.

11 Claims, 5 Drawing Sheets

COILED TUBING SYSTEM WITH MULTIPLE INTEGRAL PRESSURE SENSORS AND DTS

CROSS-REFERENCE TO RELATED APPLICATIONS

Not applicable.

BACKGROUND

Coiled tubing systems are well known in the oil and gas industry. The term normally connotes a relatively small diameter continuous tubing string that can be transported to a well site on a drum or in a reel. Some methods for inserting coiled tubing systems into existing wells are well known in the art. As oil and gas exploration technology continues to improve the demand for better wellbore information grows and there has been more interest in using coiled tubing to deploy more instrumentation into the wellbore, particularly pressure and temperature sensors.

As fiber optic telemetry develops there is increased need to install multiple fiber optic sensors inside coiled tubing. Each sensor may require its own FIMT (Fiber In Metal Tubing), so there needs to be a method and devices to enable multiple FIMTs to be installed simultaneously in lengths of coiled tubing that can be up to 10 km.

A typical fiber telemetry system inside coiled tubing can consist of three fiber optic pressure transducers, one at the heel, one at the toe and one in the middle of the horizontal portion, along with additional fiber for DTS (Distributed Temperature Sensing) and/or DAS (Distributed Acoustic Sensing) telemetry. Each sensor may have single or multiple fibers, which are normally run inside FIMTs. Thus as many as 5 or more FIMTs may have to be installed in the coiled tubing at the same time. Although the number can vary the examples given in this disclosure will demonstrate the deployment of three fiber optic pressure transducers, one at the heel, one at the toe and one in the middle of the horizontal portion, along with additional fiber for DTS and/or DAS telemetry.

The installation of pressure transducers in three different locations along with the additional optical fibers for other sensors creates a need for a pressure housing for each pressure transducer that incorporates all of the needed sensing functionality while incorporating the capabilities for installation inside the cramped confines of coiled tubing. It is desirable to do this with approaches that result in little strain on the fibers, and in which there is no need for extensive cutting of the tubing in order to produce the coiled tube sensor assemblies.

DETAILED DESCRIPTION

Figure 1:
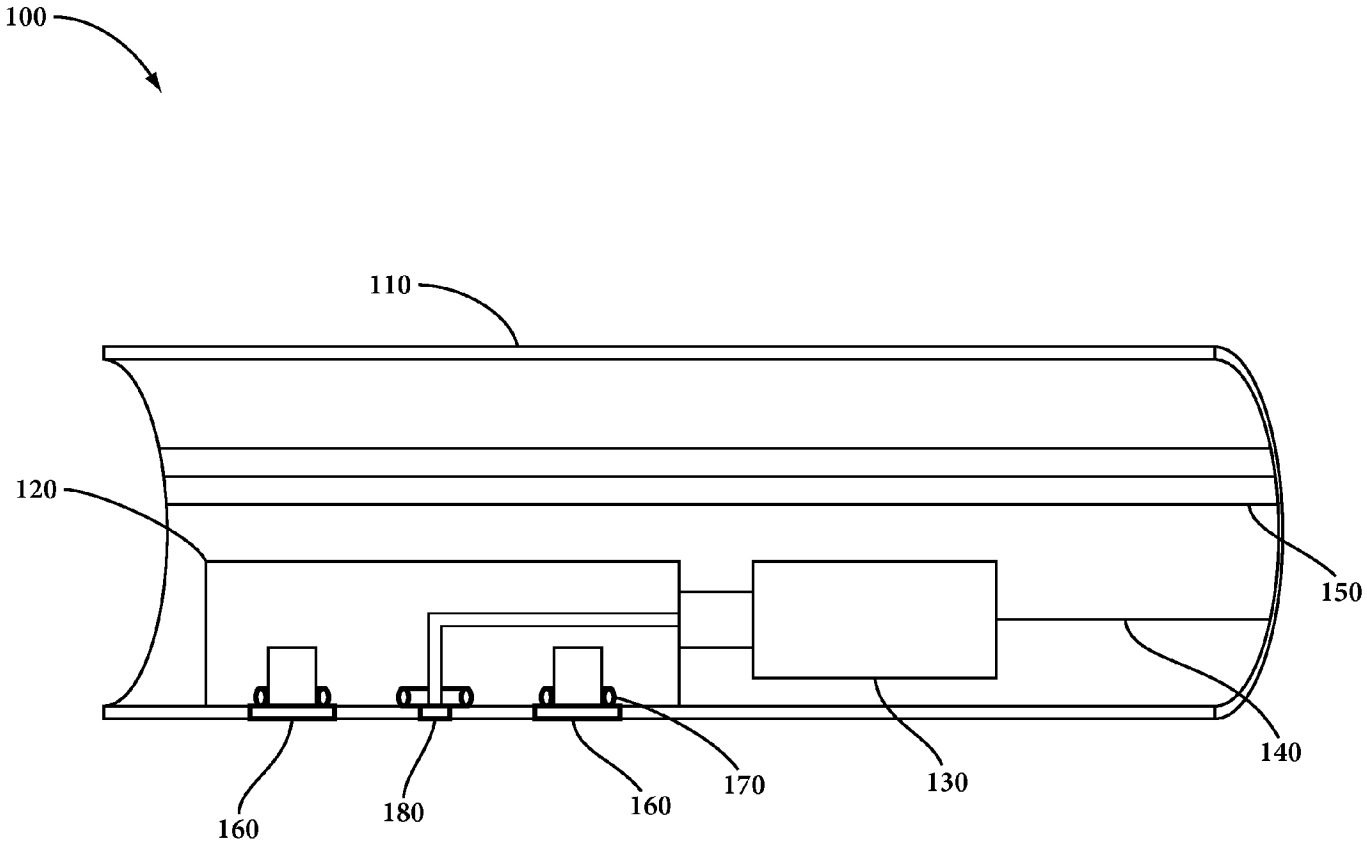
FIG. 1 illustrates a first embodiment of a pressure housing for a pressure transducer installation in coiled tubing.

In the following detailed description, reference is made that illustrate embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken in a limited sense, and the scope of the disclosure is defined only by the appended claims.

As previously discussed, a typical fiber telemetry system inside coiled tubing can consist of three fiber optic pressure transducers, one at the heel, one at the toe and one in the middle of the horizontal portion, along with additional fiber for DTS (Distributed Temperature Sensing) and/or DAS (Distributed Acoustic Sensing) telemetry. Each of the multiple pressure transducers must be placed and then fastened in their desired positions within the coiled tubing and have a pressure inlet port opening through the coiled tubing wall to convey formation pressure internally to the pressure transducer. The pressure inlet port opening is in fluid communication through the pressure block housing to the pressure transducer. Each of the multiple pressure transducers must also allow for the passage of other FIMT's or electrical cables through the coiled tubing.

The sensors, comprising e.g., fiber optic, vibrating wire or TEC (Tubing Encapsulated Conductor) cables, chemical sensors, electromagnetic sensors, pressure sensors and pressure block housing can be pulled and/or pumped into the coiled tubing. The sensing string can also include various electrical sensors, including point thermocouples for temperature sensing as well as DTS system calibration. The DTS and or DAS fibers can be deployed inside a FIMT along with the pressure sensors, or pumped into a conduit after installation. The fiber for the DTS can be pumped into a double-ended conduit for some coil deployments. The location of the pressure transducers, e.g. pressure sensor and pressure block housing are carefully measured before they are pulled into the coil. The exact location can then be identified using e.g. x-ray systems and/or ultrasonic systems and/or DAS systems by tapping on the coiled tubing and/or by DTS systems and apply a thermal event or other similar methods where distance can be verified and compared with distances measured before the sensing string is pulled into the coiled tubing. Penetrations can then be drilled though the coil at suitable locations, and suitable seals can be applied to/activated on the assembly. All of the installation of the sensor systems into the tubing is done in the coiled tubing before the tubing is deployed downhole.

Possible multiple pressure transducer configurations are illustrated in the accompanying drawings.

FIG. 1, represented by the numeral 100, illustrates a first embodiment. The coiled tubing 110 is shown in a cross sectional view to expose the inner installation. A pressure transducer 130, with an accompanying pressure block housing 120 is first deployed into the tubing, by methods such as being pulled in or pumped in. A fiber or electrical cable 140 carrying a signal from transducer 130 is shown which carries signals back to the surface. Additional fibers or electrical cables 150 are shown which are deployed through tubing 110 to connect with additional sensors in other locations in the tubing. Once the exact location of the pressure block housing is identified a drilling jig is then used to drill precise holes for placement of retaining screws 160 and port 180. O-rings (example 170) are then installed to insure no leakage and retaining screws are then attached and tightened in the retaining screw holes 160. The tightening of the retaining screws pulls the pressure block housing to the inner wall of coiled tubing 110 until a full seal is achieved. Port 180 is open to the oil/gas formation to allow transducer 130 to accurately measure formation properties such as pressure. After installation the system can then be tested for leaks.

Figure 2:
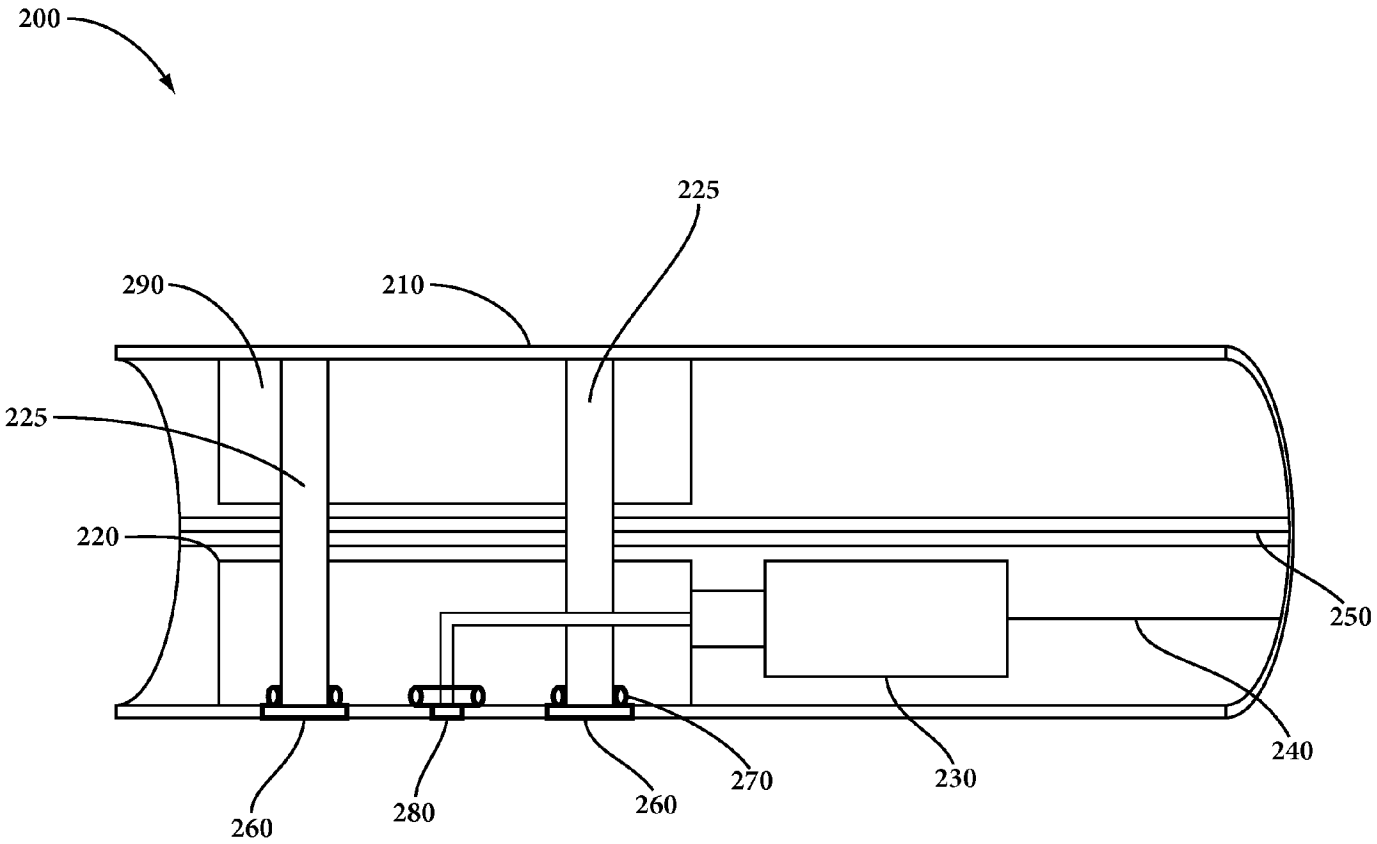
FIG. 2 illustrates a second embodiment of a pressure housing for a pressure transducer installation in coiled tubing.

FIG. 2, represented by the numeral 200, illustrates a modified second embodiment. Again the coiled tubing 210 is shown in a cross sectional view to expose the inner installation. In this embodiment an alternate combination is pulled into tubing 210 that includes not only the pressure block housing 220 and sensor but also a wedge 290 that is pushed up against the distant inner wall of tubing 210 forcing the pressure block housing 220 to butt up against the inner wall and improve the seal. Additional fibers or electrical cables 250 are shown which are deployed through tubing 210 to connect with additional sensors in other locations in the tubing. Pins 225 inserted through pressure block housing 220 and wedge 290 provide improved stability. Again the exact location of pressure block housing 220 is identified and a drilling jig is then used to drill precise holes for placement of retaining screws 260 and port 280. O-rings (example 270) are then installed to insure no leakage and longer retaining screws are then attached and tightened in the retaining screw holes 260 and tightened to force wedge 290 against the far wall of the tubing. As in the first embodiment port 280 is open to the oil/gas formation to allow sensor 230 to accurately measure formation properties such as pressure. After installation the system can then be tested for leaks.

Figure 3:
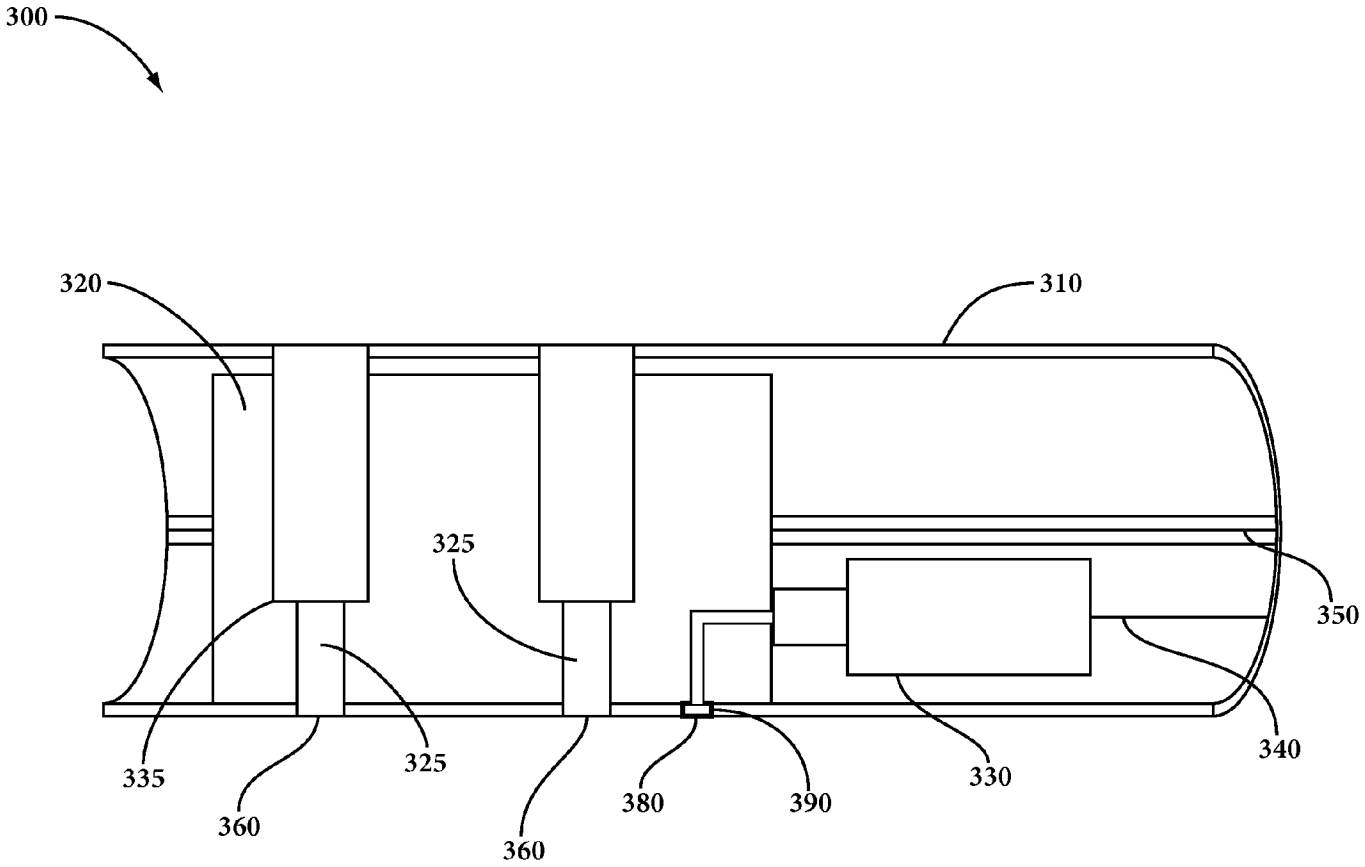
FIG. 3 illustrates a third embodiment of a pressure housing for a pressure transducer installation in coiled tubing.

FIG. 3, represented by the numeral 300, illustrates a third embodiment. Again the coiled tubing 310 is shown in a cross sectional view to expose the inner installation. In this embodiment an alternate combination is pulled into tubing 310 that includes a larger pressure block housing 320 and pressure sensor 330, connected back to the surface via fiber or electrical cable 340. Additional fibers or electrical cables 350 are shown which are deployed through tubing 310 to connect with additional sensors in other locations in the tubing. An alternate pin design, including retaining pins 325 inserted through pressure block housing 320, with a shoulder pin 335 provides improved stability. Again the exact location of the pressure block housing is identified and a drilling jig is then used to drill precise port and retaining holes through the coiled tubing walls. The retaining pins are inserted through the drilled holes and tightened to force pressure port 320 against the inner walls of tubing 310. The pins are then welded to the coiled tubing on both sides and ground flush to both provide strong support and seal against leaks. An O-ring (example 390) is then installed to insure no leakage at port 380. As in the first embodiment port 380 is open to the oil/gas formation to allow sensor 330 to accurately measure formation properties such as pressure. After installation the system can then be tested for leaks.

Figure 4:
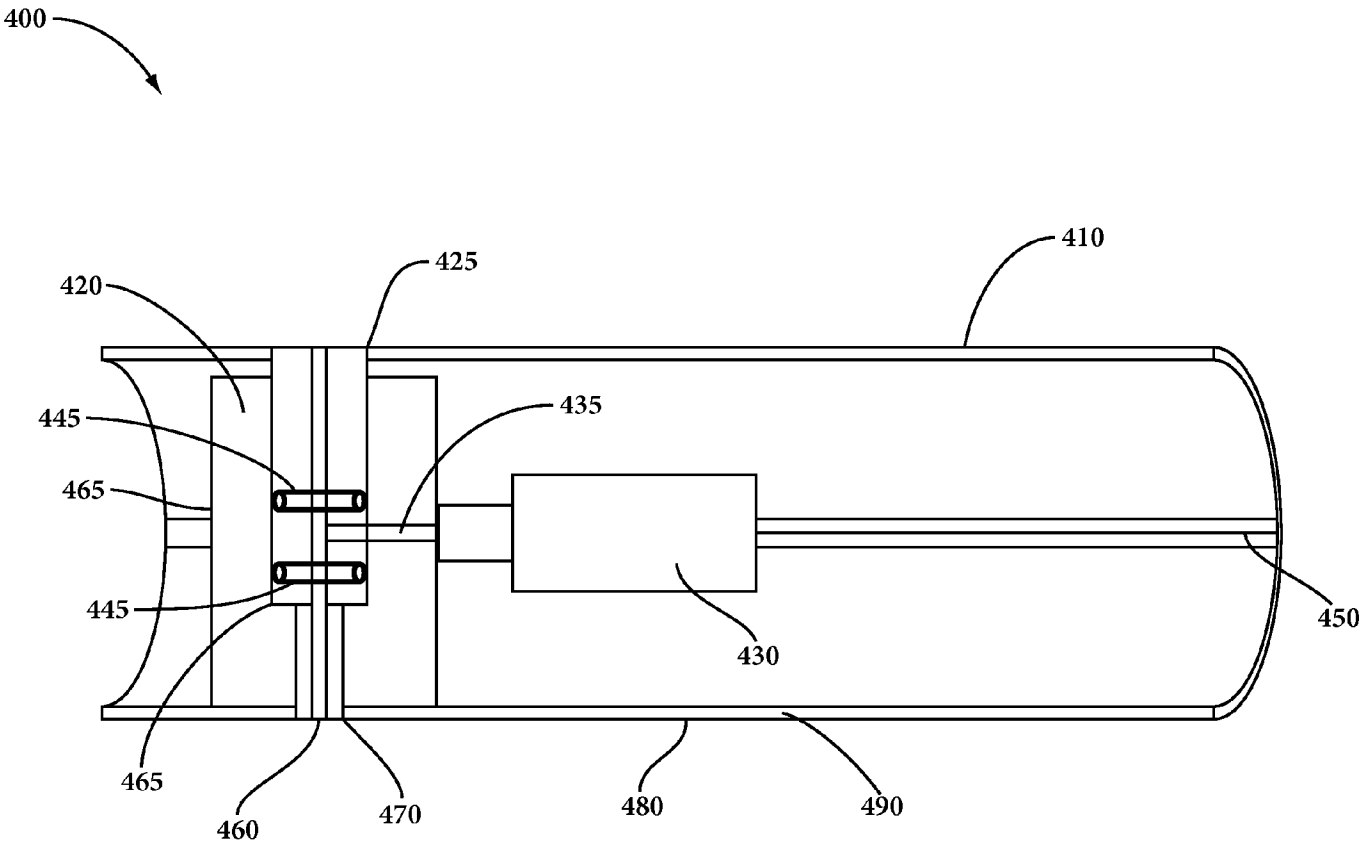
FIG. 4 illustrates a fourth embodiment of a pressure housing for a pressure transducer installation in coiled tubing.

In a final embodiment, shown in FIG. 4 as numeral 400, features a more compact pressure block housing 420 and pressure sensor 430 in conjunction with a single pin structure with an internal port 460. Fibers or electrical cables 450 are shown which are deployed through tubing 410 to connect with sensors in various locations in the tubing. The pin structure comprises a retaining pin 470 topped with a shoulder pin 465 that extends to the far side of the tubing. Sensor 430 is in fluid communication with internal port 460 and is isolated with two internal O-rings or seals. Again the exact location of the pressure block housing is identified and a drilling jig is then used to drill precise pinholes for and retaining pin 470 and shoulder pin 465 through the coiled tubing walls. The complete retaining pin with seals is then inserted through the tubing walls and tightened to force pressure block housing 420 against the tubing walls. The pins are then welded to the coiled tubing on both sides and ground flush to both provide strong support and seal against leaks.

The embodiments discussed in FIGS. 1-4 provide multiple pressure transducer systems that require no packers for isolation of the pressure sensor system. In addition they result in multiple pressure transducer systems that remove any strain on the sensors and fibers since the rigid application of the systems to the coiled tubing walls allow the coiled tubing walls to handle the strain. None of the embodiments require any cutting of tubing—only the drilling of small holes for the inserting of pins and pressure ports.

It can be observed in FIGS. 1-4 that each of the figures shows additional fibers or electrical connections that are passing down the coiled tubing for communications with other sensors or back to the surface. Many of the fibers that pass down coiled tubing are in FIMTs (fibers in metal tubing). Since each of the embodiments of pressure housings shown in FIGS. 1-4 pass completely across and are in fact wedged into the coiled tubing there must be a design of the pressure housing that allows the various FIMT's to pass down the coiled tubes and past the multi pressure housings.

Figure 5:
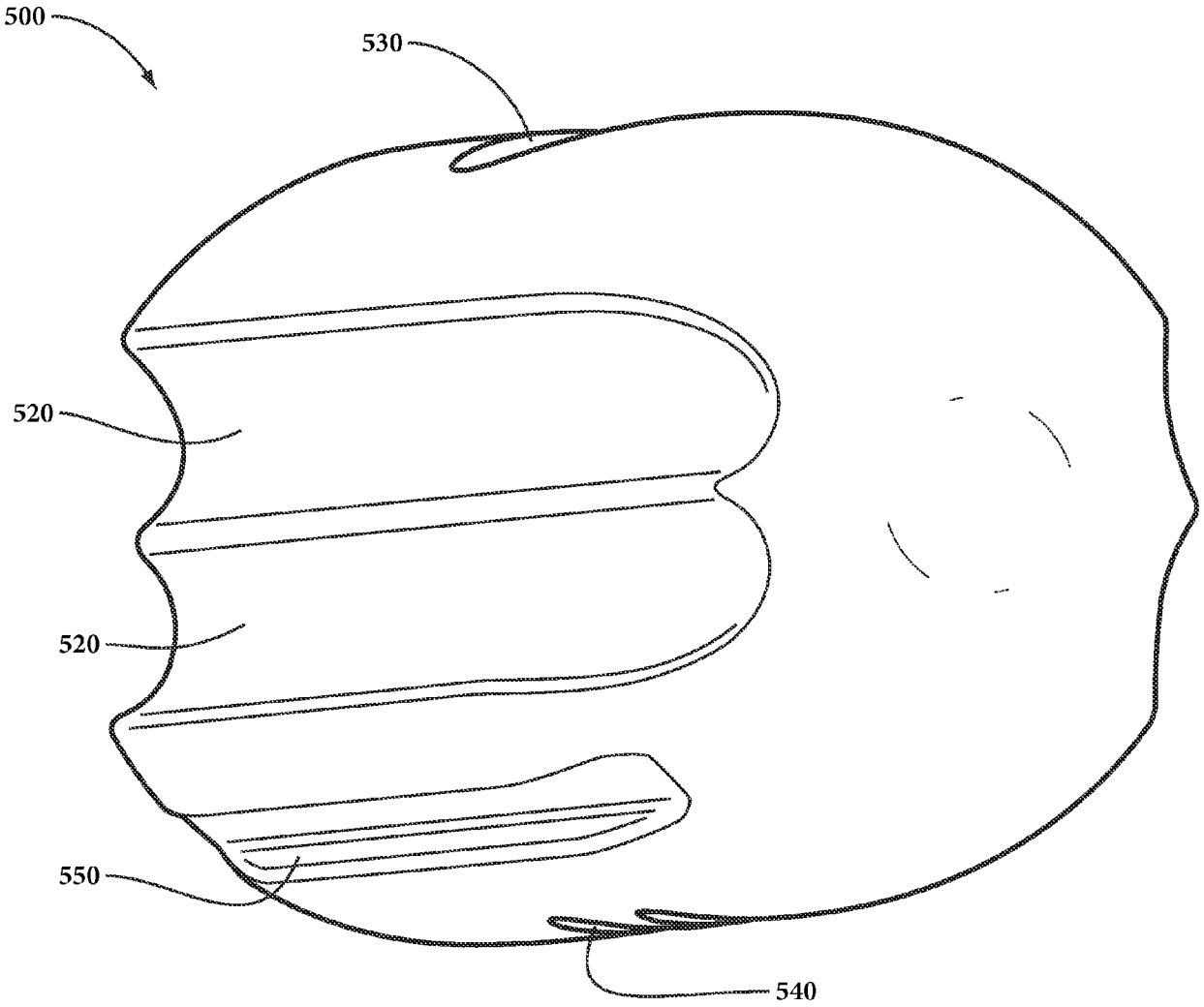
FIG. 5 illustrates an exterior for a pressure housing for a pressure transducer installation in coiled tubing.

FIG. 5, represented by the numeral 500, illustrates a pressure-housing exterior that makes this possible. Grooves 520 along both sides of the pressure-housing exterior are passageways for multiple FIMTs as well as pull cables that can traverse past the pressure block housing without clamping to it. Pinholes 530, 540 on the top and bottom of the housing allow the pin structures to be inserted after drilling of the coiled tubing and a guide slot 550 enables the pressure housing assembly to align correctly along the coiled tubing during installation. Coiled tubing may have an interior weld seam that runs completely through the coiled tube as a result of the manufacture of the tubing. The guide slot 550 may ride along that during the pull through installation of the pressure housings in the coiled tubing.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A multiple integral pressure transducer system for installation in downhole coiled tubing systems connected to the surface wherein each integral pressure transducer comprises:

a. a pressure block housing;

b. at least one retaining pin passing through the walls of the coiled tubing and through each pressure block housing;

c. a pressure sensor mounted to each pressure block housing and connected back to the surface;

d. at least one pressure inlet port opening through the walls of the coiled tubing and into each pressure block housing to convey formation pressure internal to the coiled tubing;

e. wherein each pressure inlet port opening is in fluid communication through the pressure block housing to each pressure sensor; and f. wherein each pressure block housing exterior comprises external grooves that allow additional fiber or electrical cable lines for other downhole sensors to traverse past each pressure block housing without clamping to each pressure block.

2. The multiple integral pressure transducer system for installation in downhole coiled tubing systems connected to the surface of claim 1 wherein the at least one retaining pin passing through the walls of the coiled tubing and through each pressure block housing is secured with a retaining screw.

3. The multiple integral pressure transducer system for installation in downhole coiled tubing systems connected to the surface of claim 1 wherein the at least one retaining pin passing through the walls of the coiled tubing and through each pressure block housing is secured by welding the pin to the coiled tubing on both sides.

4. The multiple integral pressure transducer system for installation in downhole coiled tubing systems connected to the surface of claim 1 wherein each pressure block housing exterior further comprises an exterior guide slot that rides the weld seam inside the coiled tube to align each pressure housing during installation.

5. The multiple integral pressure transducer system for installation in downhole coiled tubing systems connected to the surface of claim 1 wherein there is one retaining pin passing through the walls of the coiled tubing and through each pressure block housing and where the inlet port opening in fluid communication with each pressure sensor is isolated with two internal O-rings or seals.

6. The multiple integral pressure transducer system for installation in downhole coiled tubing systems connected to the surface of claim 1 wherein the additional fiber or electrical cable lines for other downhole sensors that traverse past each pressure block housing without clamping to each pressure block housing are for fiber optic/vibrating wire sensors.

7. The multiple integral pressure transducer system for installation in downhole coiled tubing systems connected to the surface of claim 1 wherein the additional fiber or electrical cable lines for other downhole sensors that traverse past each pressure block housing without clamping to each pressure block housing are for chemical sensors.

8. The multiple integral pressure transducer system for installation in downhole coiled tubing systems connected to the surface of claim 1 wherein the additional fiber or electrical cable lines for other downhole sensors that traverse past each pressure block housing without clamping to each pressure block housing are for electromagnetic sensors.

9. The multiple integral pressure transducer system for installation in downhole coiled tubing systems connected to the surface of claim 1 wherein the additional fiber or electrical cable lines for other downhole sensors that traverse past each pressure block housing without clamping to each pressure block housing are for tubing encapsulated cable systems.

10. The multiple integral pressure transducer system for installation in downhole coiled tubing systems connected to the surface of claim 1 wherein the additional fiber or electrical cable lines for other downhole sensors that traverse past each pressure block housing without clamping to each pressure block housing are for electrical sensors.

11. The multiple integral pressure transducer system for installation in downhole coiled tubing systems connected to the surface of claim 10 wherein the electrical sensors comprise point thermocouples for temperature or DTS calibrations.

* * * * *